United States Patent [19]

Cooper et al.

[11] 4,008,918

[45] Feb. 22, 1977

[54] CHAIRS

[75] Inventors: Howard Lee Cooper, Ashbourne; Stewart Banks, Ticknall, both of England

[73] Assignee: Products for Proud Parents Limited, Derby, England

[22] Filed: July 2, 1975

[21] Appl. No.: 592,422

[30] Foreign Application Priority Data

Aug. 7, 1974 United Kingdom ..... 34738/74
Oct. 17, 1974 United Kingdom ..... 45440/74

[52] U.S. Cl. ..... 297/16; 297/56; 297/148

[51] Int. Cl.[2] ..... A47C 4/00; A47B 39/00

[58] Field of Search ..... 297/148, 56, 16, 46, 297/27, 28, 345, 150, 151, 152, 153, 170; 248/421

[56] References Cited

UNITED STATES PATENTS

| | | | |
|---|---|---|---|
| 387,586 | 8/1888 | French | 297/345 X |
| 867,465 | 10/1907 | Bacon | 297/16 X |
| 949,421 | 2/1910 | Francis | 297/345 X |
| 1,789,090 | 1/1931 | Wawrunek | 297/28 |
| 2,664,143 | 12/1953 | Licalsi | 297/345 X |
| 3,061,262 | 10/1962 | Nika | 297/16 X |

FOREIGN PATENTS OR APPLICATIONS

| | | | |
|---|---|---|---|
| 532,993 | 9/1955 | Italy | 297/345 |

*Primary Examiner*—James T. McCall
*Attorney, Agent, or Firm*—Alan H. Levine

[57] ABSTRACT

A baby chair having a seat and a tray both mounted on a collapsible framework, the seat having a bottom and a back hinged together and pivotally connected to the framework, and the framework being so constructed that, when not in use, the chair may be collapsed to form a substantially flat assembly.

5 Claims, 6 Drawing Figures

CHAIRS

The invention relates to baby chairs.

Baby chairs of the kind having a seat and a tray supported in front of the seat on arm-rest members in such a way that a child is restrained in the seat, are known. Because it is desirable to have the seat and tray at about normal table height, these chairs are usually extremely bulky and are difficult to store and transport.

It is an object of the present invention to provide a baby chair in which the above disadvantage is obviated or mitigated.

The invention provides a baby chair having a seat and a tray both mounted on a collapsible framework, the seat having a bottom and a back hinged together and pivotally connected to the framework, and the framework being so constructed that, when not in use, the chair may be collapsed to form a substantially flat assembly.

In one form of the invention the bottom and back of the seat are pivotally connected to different members of the framework and when the framework is collapsed the angle between the bottom and back members of the seat increases so that the two form an extension of one another in the same general plane. In an alternative arrangement the bottom and back of the seat may be pivotally connected to the same member of the framework, one of the pivotal connections being slidable and the arrangement being such that on collapsing of the framework the back and bottom of the seat fold over on to one another.

Irrespective of the manner in which the seat is mounted on the framework one of its pivotal mountings is preferably slidable relative to the framework in a slotted bracket secured to one of the frame members.

Preferably the framework comprises two side frames in the form of X frames, one forming the legs or ground engaging portions of the chair, and the other, mounted on top of the first, serving to support the seat and tray, the members of the framework being pivotally interconnected to form a lattice type structure which may be collapsed from an extended condition to a substantially flat condition. The framework is preferably made from lightweight tubular metal.

The seat may comprise separately formed back and bottom members and a hinge pivotally connecting same together. Alternatively the seat could be formed from an integral moulding in polyproplene or other suitable material having a web-like region extending transversely thereof and forming a hinge between the bottom and back of the seat.

Embodiments of the invention will now be described, by way of example only, with reference to the accompanying drawings, in which.

Figure 1:
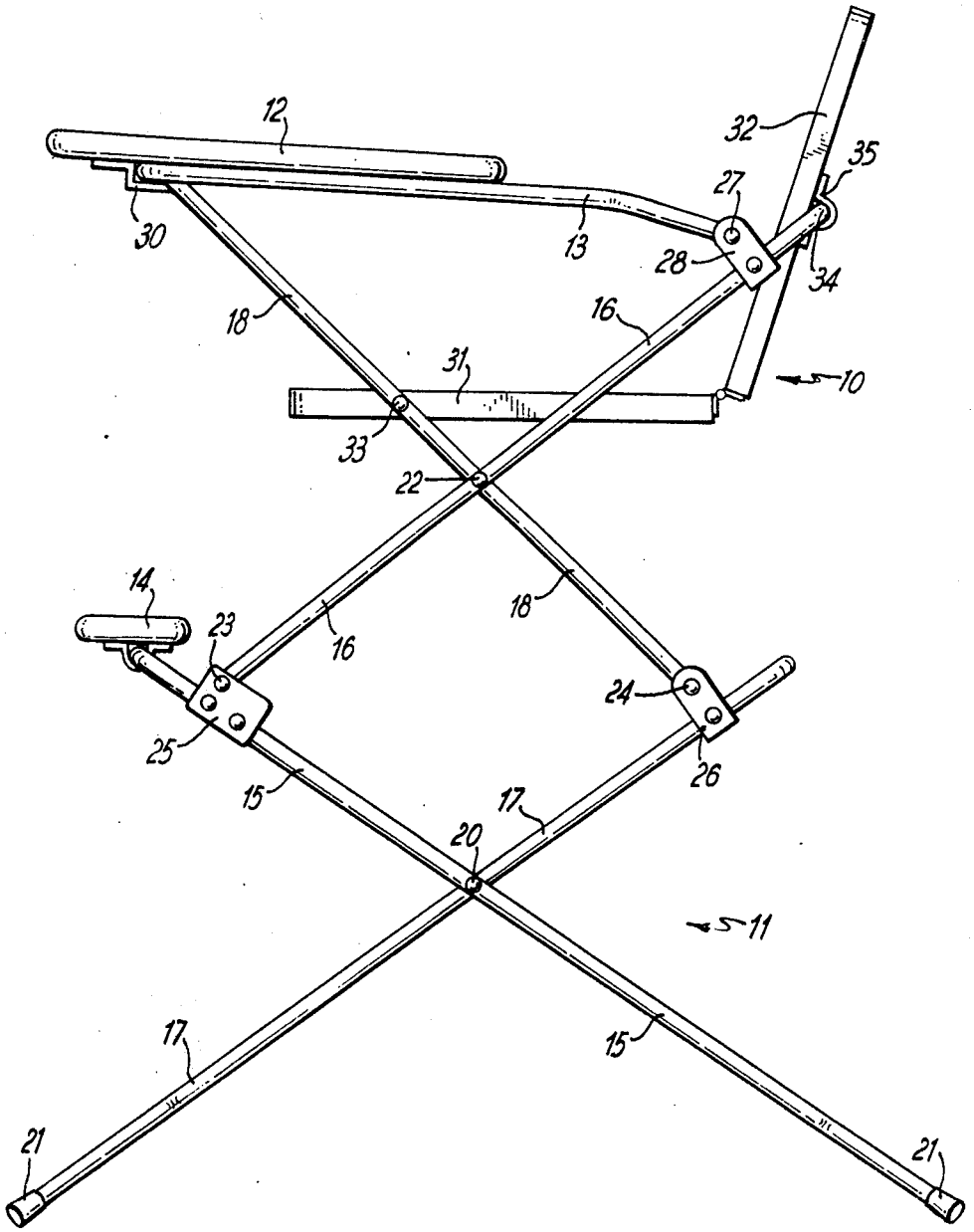
FIG. 1 is a side elevation of a baby chair according to the invention in its erected condition.

Referring to FIGS. 1 to 4, the baby chair comprises a seat 10 supported on a tubular metal framework 11, a tray 12 supported above the front portion of the seat 10 on a frame member 13, and a foot rest 14 supported in front of and below the seat 10 upon a frame member 15.

The framework 11 consists of five frame members 13, 15, 16, 17 and 18. Each of these members is formed from tubular metal and has parallel side portions of equal length joined by a cross-member substantially at right angles to the parallel side portions. Frame members 17 and 18 have a smaller distance between their parallel side portions than frame members 13, 15 and 16 so that frame members 17 and 18 may be pivoted to frame members 15 and 16 respectively on the insides thereof.

Frame members 15 and 17 are pivoted together on each of their parallel portions at points 20 to form an "X" frame as viewed from the side. The ends of the parallel portions of frame members 15 and 17 remote from the respective cross members form the ground engaging portions of the chair and are fitted with rubber caps 21 to prevent damage to floor surfaces.

A second X frame is formed by the frame members 16 and 18 which are pivoted together at either side of the chair at points 22. The lower ends of members 16 and 18 are pivotally secured at points 23 and 24 to brackets 25 and 26 mounted on the parallel portions of frame members 15 and 17 respectively, adjacent their respective cross members. Pivot points 20, 22, 23 and 24 are arranged so that the distances between points 20 and 23 and 22 and 23 are equal and the distances between points 20 and 24 and 22 and 24 are equal; in this way the two X frames form a folding lattice type structure which may be fully collapsed to form a flat assembly.

Frame member 13 which supports the tray 12 is pivotally attached at each of its free ends at points 27 to brackets 28 which are mounted on the parallel portions of frame member 16 adjacent its cross member, so that the parts of the parallel portions between the tray 12 and the pivot 27 form arm rests which, together with the tray, restrain a child when seated in the chair.

The tray 12 is secured to the frame member 13 by screws or similar means, and a bracket 30 is provided on the underside of the tray which locates over the cross member of frame member 13 and forms a retainer in which the cross member of frame member 18 may be engaged to tension and hold the framework in its erected condition.

The seat 10 is formed from two members, namely a bottom portion 31 and a back portion 32 which are hinged together. The bottom portion 31 is pivotally connected at points 33 on either side to the parallel portions of frame member 18, and the back portion 32 is pivotally mounted at points 34 to the cross member of frame member 16 by means of brackets 35. The pivot points 33 and 34 are arranged so that when the chair is in its erected condition, as shown in FIGS. 1 to 3, the back portion 32 is at right angles or slightly more than right angles to the bottom portion 31 and the sum of the distance from the points 33 to the rear of the bottom portion 31 and the distance from the points 34 to the base of the back portion 32 is approximately equal to the sum of the distances between points 33 and 22 and 22 and 34, so that in the collapsed condition, as shown in FIG. 4, the seat will be flattened out.

Figure 2:
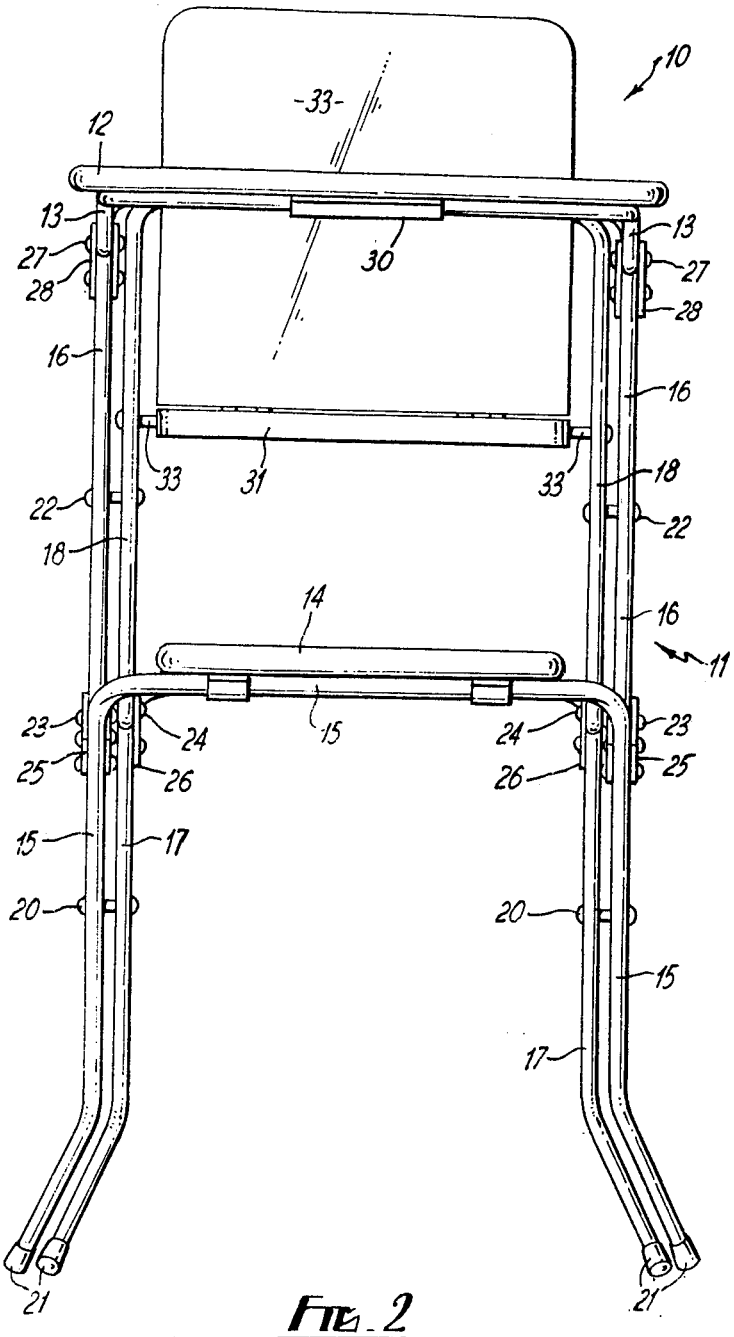
FIG. 2 is a front elevation of the baby chair shown in FIG. 1.
Figure 3:
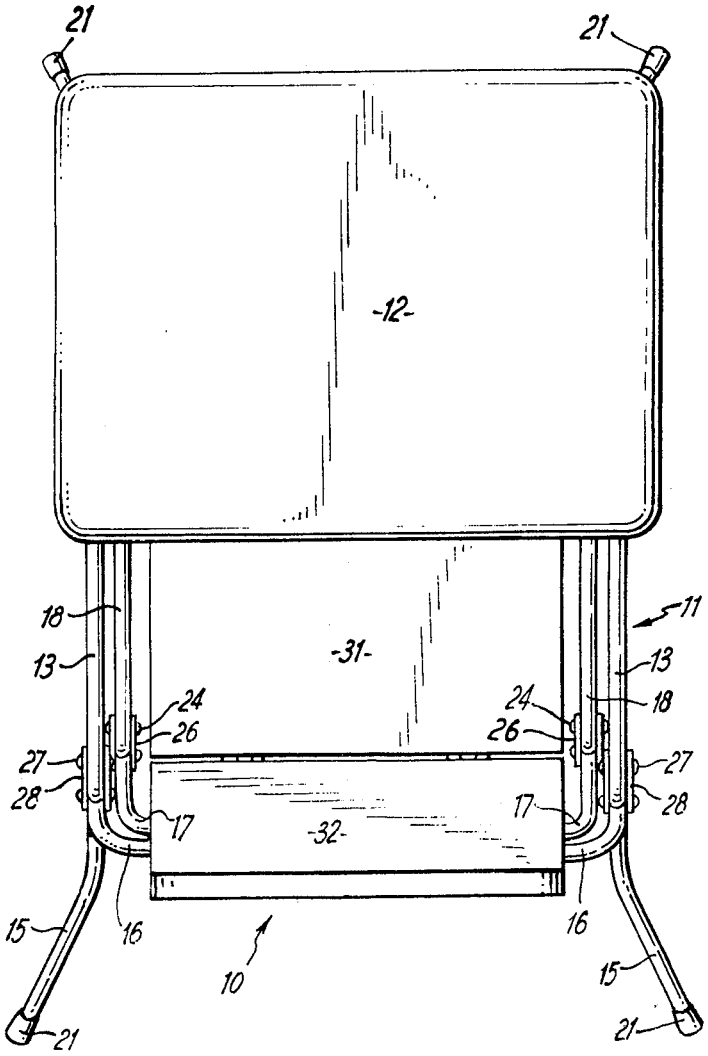
FIG. 3 is a plan view of the baby chair shown in FIG. 1.
Figure 4:
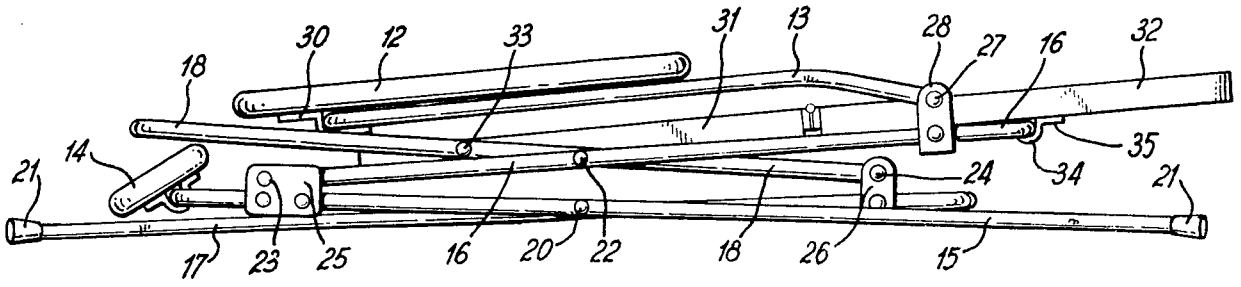
FIG. 4 is a side elevation of the baby chair shown in FIG. 1 in its collapsed condition.

In order to collapse the baby chair from its erected condition as shown in FIGS. 1 to 3 to its collapsed condition as shown in FIG. 4, the framework 11 is extended slightly so that the cross member of the frame member 18 becomes disengaged from the retainer formed by the bracket 30. The tray 12 and the supporting frame member 13 are then raised slightly and the framework 11 is allowed to collapse. The chair is erected by reversing the above operations.

Figure 6:
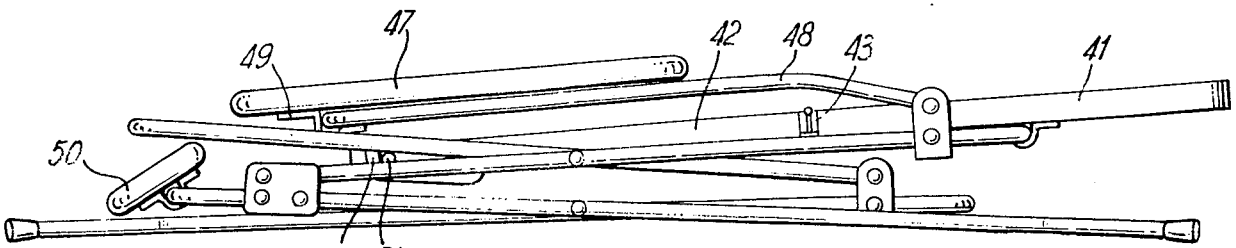
FIG. 6 is a side elevation of the chair shown in FIG. 5 in its collapsed condition.
Figure 5:
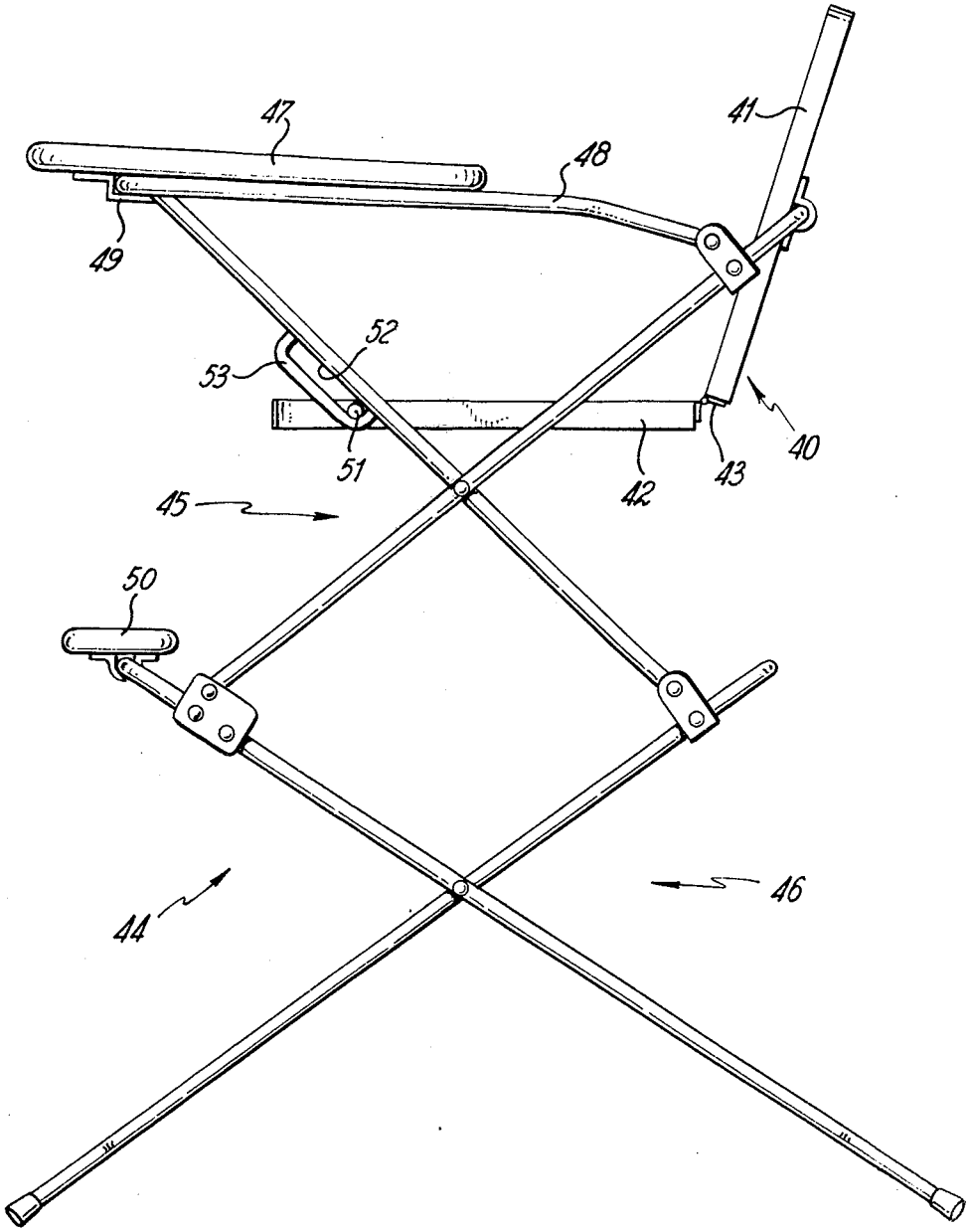
FIG. 5 is a side elevation of a slightly modified form of baby chair according to the invention in its erected condition.

The chair illustrated in FIGS. 5 and 6 is similar in most respects to that described with reference to FIGS. 1 to 4. It consists primarily of a seat 40 having a back member 41 and a bottom member 42 connected together by a hinge 43 and pivotally connected to the upper portion of a collapsible frame 44. The frame comprises upper and lower X-frames 45, 46 at each side interconnected by cross members at the upper ends of each X-frame. A tray 47 is supported on an upper frame consisting of a cross member interconnecting a pair of generally horizontal side members 48. The tray has a depending clip 49 which engages beneath the cross member and a similar cross member interconnecting the upper X-frames to lock the assembly in the erected position. A foot rest 50 is supported on one of the cross members connecting the upper ends of the lower X-frames.

The bottom portion of the seat has studs 51 secured to its opposite sides, each stud being slidable in a slot 52 in a bracket 53 attached to one of the members forming the upper X-frame. These brackets allow the studs 51 to slide relative to the associated frame members during collapsing of the chair. In the erected condition the studs seat in the lower ends of the slots in the brackets and are thus held against downward movement. This arrangement enables a more convenient overall height combined with the most satisfactory angle between the back and bottom portions of the seat (approximately 90°) to be achieved compared with a fixed pivot arrangement of the kind shown in FIGS. 1 to 4.

In order to collapse the chair to the position shown in FIG. 2, the frame constituted by the upper and lower X-frames is extended slightly so that the cross-piece connecting the front of the upper X-frames becomes disengaged from beneath the clip 49 on the tray 47. The framework may then collapse in concertina fashion to the position shown in FIG. 2, the angle between the back and bottom portions of the seat increasing so that the two parts effectively form an extension of one another. During such movement the studs 51 slide in the slots in the brackets 53.

The arrangements described thus provide a baby chair which may be fully collapsed so that it is easily stored or may fit easily into the boot of a car and which can be erected or collapsed easily with one hand.

Various modifications may be made without departing from the invention. For example the construction of the framework and the manner in which the seat is constructed and pivoted to the framework may be altered as desired provided that the seat may collapse when not required for use to form a substantially flat assembly. Thus though the seat illustrated comprises separate back and bottom members interconnected by a conventional hinge, the seat may be of integral construction moulded from polyproplene or other suitable synthetic plastics material the cross-section of which is reduced to a thin web at the junction of the back and bottom members of the seat to form an integral hinge.

In a further modification the bottom and back portions of the seat may be arranged so that when the chair is collapsed the bottom and back portions of the seat move slightly past the flat position so that their points of attachment to the frame members are below the axes of the hinges joining the bottom and back of the seat thereby forming a geometric lock which retains the chair in its collapsed condition.

In yet another modification the pivots by which the upper X frame is mounted on the lower X frame may be releasable so that the upper frame and seat may be removed from the lower frame and used as a low chair. Moreover instead of using the tray-supporting member to tension the framework and retain it in its erected condition, hinged props which may be locked in their extended position may be provided between the central pivot points of the upper and lower X frames. Alternatively straps could be used between the cross members of the frame members forming the lower X frame.

We claim:

1. A baby chair having a seat and a tray both mounted on a collapsible framework comprising two side frames in the form of X frames, one forming the legs or ground-engaging portion of the chair, and the other, mounted on top of the first, serving to support the seat and tray, the members of the framework being pivotally interconnected to form a lattice type structure which may be collapsed from an extended condition to a substantially flat condition, the seat having a bottom and a back hinged together and both pivotally connected to the framework, and the tray being supported in front of the seat and including a retaining member on its underside for releasable engagement with a cross member at the upper forward end of the upper X frame to maintain the framework in the erected condition.

2. A baby chair according to claim 1 wherein the bottom and back of the seat are pivotally connected to different members of the framework and when the framework is collapsed the angle between the bottom and back members of the seat increases so that the two form an extension of one another in the same general plane.

3. A baby chair according to claim 2 wherein one of said pivotal connections is slidable relative to the framework in a slotted bracket secured to one of the frame members.

4. A baby chair according to claim 1 wherein the upper and lower X frames are detachably connected to one another.

5. A baby chair according to claim 4 including armrest members extending between the tray and the seat at opposite sides.

* * * * *